United States Patent [19]

Kobayashi et al.

[11] 4,093,858

[45] June 6, 1978

[54] CESIUM INJECTION SYSTEM FOR NEGATIVE ION DUOPLASMATRONS

[75] Inventors: Maasaki Kobayashi, Oho, Japan; Krsto Prelec, Setauket; Theodorus J Sluyters, East Patchogue, both of N.Y.

[73] Assignee: The United States of America as represented by the United States Department of Energy, Washington, D.C.

[21] Appl. No.: 804,189

[22] Filed: Jun. 6, 1977

[51] Int. Cl.[2] ..... H01J 27/00

[52] U.S. Cl. ..... 250/424; 250/425

[58] Field of Search ..... 250/423–427

[56] References Cited

U.S. PATENT DOCUMENTS

| | | | |
|---|---|---|---|
| 3,374,384 | 3/1968 | Donnally | 250/427 |
| 3,740,554 | 6/1973 | Morgan | 250/423 |
| 3,864,575 | 2/1975 | Hashmi | 250/425 |

*Primary Examiner*—Harold A. Dixon

*Attorney, Agent, or Firm*—Dean E. Carlson; Leonard Belkin

[57] ABSTRACT

Longitudinally extending, foraminous cartridge means having a cylindrical side wall forming one flat, circular, tip end surface and an opposite end; an open-ended cavity, and uniformly spaced orifices for venting the cavity through the side wall in the annulus of a plasma ring for uniformly ejecting cesium for coating the flat, circular, surface. To this end, the cavity is filled with a cesium containing substance and attached to a heater in a hollow-discharge duoplasmatron. By coating the flat circular surface with a uniform monolayer of cesium and locating it in an electrical potential well at the end of a hollow-discharge, ion duoplasmatron source of an annular hydrogen plasma ring, the negative hydrogen production from the duoplasmatron is increased. The negative hydrogen is produced on the flat surface of the cartridge and extracted by the electrical potential well along a trajectory coaxial with the axis of the plasma ring.

10 Claims, 2 Drawing Figures

CESIUM INJECTION SYSTEM FOR NEGATIVE ION DUOPLASMATRONS

BACKGROUND OF THE INVENTION

In the field of physics a need exists for a negative ion beam. One apparatus for producing such a beam is a hollow discharge, duoplasmatron source, but heretofore such devices produced low density negative ion beams. A hollow discharge, vacuum duoplasmatron (HDD) for use in accelerators is described by the coinventors herein in 113 Nucl. Instrum. Methods 299 (1973).

SUMMARY OF THE INVENTION

It has been discovered in accordance with this invention, that the heretofore known negative hydrogen ion production from a hollow discharge duoplasmatron source of an annular plasma ring containing energetic hydrogen atoms and ions in its annulus can be increased by an order of magnitude by providing a specific cylindrical cartridge having a flat, circular tip end surface that is coated with cesium and located in an electrical potential well for extracting the negative hydrogen ions along a trajectory coaxial with the axis of the plasma ring. A specific cesium coating means is provided by a foraminous, longitudinally extending, cartridge having a heater and a hollow, vented cavity filled with a specific solid containing cesium that is evaporated at high temperature through orifices to form cesium vapor for maintaining a uniform, mono-layer of cesium as the coating on the surface at the tip of the cartridge. By locating this coated surface in the annulus of the plasma ring, where the plasma density is low, the desired negative H ions and their extraction are realized, since the coated surface is shielded from the plasma ring by the cartridge and it is in the path of the energetic hydrogen atoms around 360°.

In one embodiment, this invention provides apparatus for use with a source of an annular hydrogen plasma, comprising: longitudinally extending foraminous cartridge means having a cylindrical side wall; one, flat, circular tip end surface and an opposite other end, an openended cavity, and uniformily spaced orifices for venting the cavity through the side wall to coat the surface; electrical potential means for producing a potential well around the one tip end of the cartridge means; source means of an annular hydrogen plasma ring containing energetic hydrogen atoms in its annulus having connection tube means inside the annulus of the plasma ring at the opposite other end of the cartridge means from the one tip end for selectively opening and closing the other end of the cavity and for connecting the cartridge means to the electrical potential means in the annulus of the plasma ring; solid means containing cesium that is selectively loaded into the cavity by opening and closing the cavity with the connection means; and electrical heat source means selectively supported by and insulated from the connection means for vaporizing the cesium by heating the cartridge means to form a cesium vapor that comes out of the orifices for coating the one tip end of the cartridge means with the cesium for interaction with the energetic hydrogen atoms from the hydrogen plasma in the annulus of the plasma ring for producing the desired negative hydrogen ions at the tip end of the cartridge means and for extracting them from the one flat end in the electrical potential well along a trajectory coaxial with the axis of the plasma ring.

With the proper selection of elements and their arrangement, as described in more detail hereinafter, the desired high density, negative, hydrogen ion beam is achieved.

OBJECTS OF THE INVENTION

It is an object of this invention, therefore, to produce a high density negative hydrogen ion beam;

It is a further object to produce a high density negative hydrogen ion beam from a hollow discharge, vacuum, duoplasmatron.

The above and further novel features and objects of this invention will appear more fully from the following detailed description of one embodiment when read in connection with the accompanying drawings, and the novel features will be particularly pointed out in the appended claims. It is to be expressly understood, however, that the drawings are not intended as a definition of the invention but are for the purposes of illustration only.

BRIEF DESCRIPTION OF THE DRAWING

In the drawing, where like elements are referenced alike.

DESCRIPTION OF THE PREFERRED EMBODIMENT

This invention is useful for increasing the H minus current densities in hollow discharge duoplasmatrons for all the uses to which such beams have been applied heretofore.

In the best mode, this invention produces a high density negative ion hydrogen beam for injection into conventional apparatus. For example, the negative beam can be injected into most electrostatic accelerators, such as Tandem Van de Graaf brand accelerators, cyclotrons, and preinjectors for linear accelerators. Moreover, by scaling-up this invention, it will be possible to produce an efficient neutral beam source. To this end, the negative beam is injected into a conventional neutralizer for converting the negative beam into a neutral ion beam for injection into a high temperature plasma to increase the temperature and/or density thereof and/or to produce high temperature reactions therein. Thus, this invention is adapted to be useful in providing potent means for producing heat and reaction products, such as light, x-rays and/or neutrons.

Figure 1:
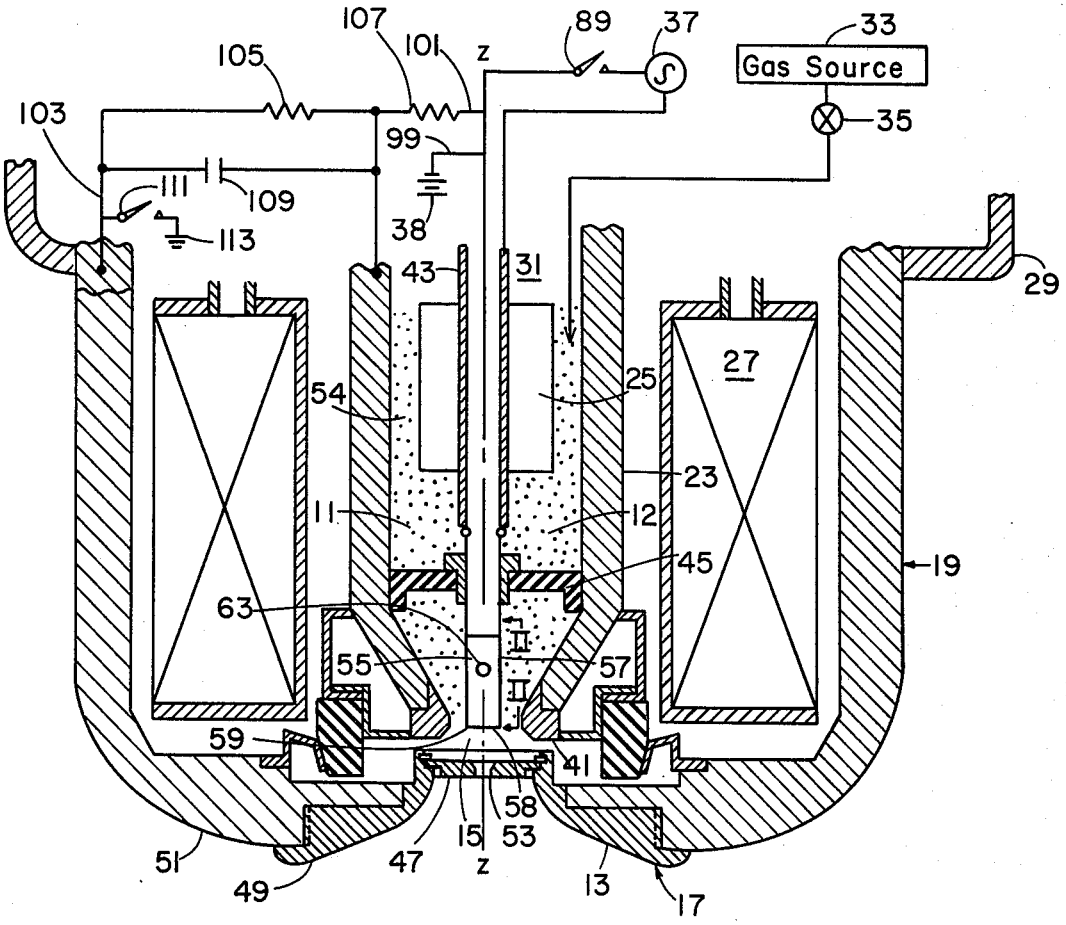
FIG. 1 is a partial cross-section of the cartridge and other apparatus of this invention in a hollow discharge, vacuum duoplasmatron for producing an annular plasma.

Referring to FIG. 1, it is known that negative hydrogen ions ($H^-$) may be produced in a plasma producing cathode discharge and extracted along the z-z axis of a hollow discharge duoplasmatron source (HDD). To this end, plasma 11 in an annular plasma ring 12 is produced and directed toward a positively charged anode 13 that produces an electrical potential well 15 at the open end 17 of the duoplasmatron 19 where the $H^-$ ions are extracted The plasma 11 forms between an annular intermediate electrode 23 and an annular negative cathode 25 inside an annular magnet 27 enclosed in a vacuum container 29 forming an enclosed space 31. The cathode has a high enough temperature to emit electrons and to ionize hydrogen gas that is released into the evacuated space 31 from a suitable tank 33 by a solenoid activated pulser valve 35. In the continuously operating mode, the valve can be used for continuously releasing the hydrogen under pressure into the space 31, in which case this space 31 is continuously evacuated to the desired pressure by vacuum means (not shown).

It is convenient to provide direct extraction of negative $H^-$ ions along the *z—z* axis of the HDD through the anode at the open end 17 of the HDD by providing suitable power supplies 37 and 38 having conventional circuit elements that cause the desired cathode heating and electrical potential gradient between the anode and the other two electrodes that are insulated from each other by insulator 39. Also provided are a removable snout 41 and a center-piece 43 having a three-spoked boron nitride support wheel 45 for establishing the desired dimensional relationship along the *z—z* axis. The anode 13 is usually made from separate high temperature components for ease of operation, comprising a mobybdenum piece 47 having a stainless steel support 49 and an iron field shaping means 51 for shaping the magnetic field produced in the exit window 53 of the anode by the magnet 27. The distance between the various electrodes may be manually remotely adjusted by conventional mechanical biasing means (not shown) that are sealed with the vacuum container 29.

It has been discovered that the center-piece 43 can have a longitudinally extending shape and structure for creating an annular plasma ring 12 near the cathode along the *z—z* axis of the HDD peripheral region 54 where plasma efficiently forms in a circular ring 12 in a plane in space 31 normal to the *z—z* axis. Such a center-piece helps avoid the inconvenience of a high density, high temperature core discharge.

Figure 2:
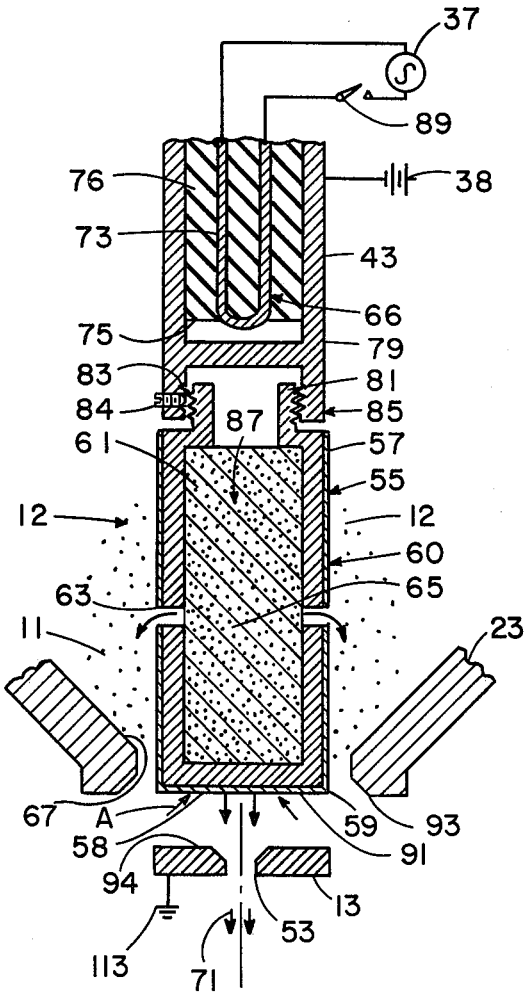
FIG. 2 is a partial cross-section of the cartridge, heater, intermediate electrode and anode of FIG. 1.

Now should the center-piece be extended by a removable, longitudinally extending, foraminous cartridge 53 having a cylindrical side wall 57, a flat, cesium-coated, circular surface 58 at tip end 59 in the annulus 60 of the plasma ring 12, as shown in FIG. 2, which illustrates an open-ended cavity 61 and uniformly spaced orifices 63 for venting the cavity through the side wall with a cesium containing substance 65 that is heated by a heating means 66, as described in more detail hereinafter, the coated surface 58 can be located in the annulus of the plasma ring where there is a relatively low plasma density because the cartridge shields the coated surface 58 from the plasma diffusion. To this end also, the cartridge is located next to the intermediate electrode where the two electrodes form a throat 67 that restricts the plasma diffusion. Consequently, plasma particles, including $H^\circ$ particles, impinge on and hit the tip end 59 uniformly, continuously, obliquely to flat surface 58 around 360° so that there is a relatively large number of $H^-$ ions that are produced there. Moreover, these negative $H^-$ ions are ejected from the flat surface of the tip end 59 and are extracted with a relatively low angle of divergence from the exit window 53 of the anode 13 in a beam 71 along a trajectory generally coaxial with the axis of the annular hydrogen plasma ring 12, and co-axial with the *z—z* axis of rotation upon which the anode 13, cathode 25, intermediate electrode 23 and magnet 27 are centered.

The tube-shaped centerpiece 43 contains heater 66, which has a resistance heating element 73 that forms a U-shaped bend along the bottom end 75 of an insulator 76 located between the element 73 and the wall 79 of the tube-shaped centerpiece 43. The wall 79 has threads 81 that mesh with like mating threads 83 on the cartridge and/or a set screw 84 is used, so that the tube-shaped center-piece 43 removably and selectively forms a connection means 85 that supports the cartridge in the desired location as an extension of the center-piece. Also, this connection means selectively connects the cartridge to the electrical potential power means 38 for producing an electrical potential between the anode and the tip end of the cartridge. Still further, the connection means selectively opens and closes the cavity 61 for filling the cesium containing substance 65 into the cavity 61 and separates the cartridge from the connection means for replacing the cartridge. The cesium containing substance 65 is advantageously heated in the form of a solid pellet 87.

The heater 66 is energized from source 37 through switch 89 to conduct sufficient heat to the cartridge 55 to vaporize the cesium and to eject it as a vapor that comes out of the cavity 61 through four equally spaced orifices symmetric with and centered on the *z—z* axis, which is coaxial with the axis of rotation of the cartridge and the center of the active surface 58. Also, the orifices radiate symmetrically at right angles to the *z—z* axis. This causes the cesium to maintain a uniform coating 91 in the form of a monolayer of cesium on the flat surface 58 at the tip end of the cartridge in the annulus of the plasma ring at the center of the intermediate electrode and adjacent the end 93 thereof. This monolayer of cesium is also parallel with the top surface 94 of the anode and parallel with the plane of the plasma ring, which is normal to and centered on the *z—z* axis. The center of the surface 58 is also co-axial with the center of the exit window 53. Thus, the $H^-$ ions are ejected by the electrical potential field with the desired trajectory along the *z—z* axis in a direction co-axial with the axis of rotation of the plasma ring.

In the embodiment of FIG. 1, the electrical potential is supplied by source 38 through a lead 99 that is in operable association with leads 101 and 103 having suitable resistors 105 and 107, a capacitor 109, and a switch 111 to ground 113, but a variety of suitable connections can be made by one skilled in the art.

In the operation of one example, the cesium layer is applied at about 600° C for about 1 hour in a separate vacuum container. The coated cartridge is then assembled on the connection means and the switches for the heater and the electrical potential well are closed.

While, the chemical reactions and electrical arrangement are complicated, and several different mechanisms have been proposed to explain the results obtained in various tests, it is believed that the plasma ring contains energetic hydrogen atoms and ions that uniformly impinge on the cesium coated surface 58 around 360°, as illustrated by arrows A in FIG. 2, to form an intermediate molecular CsH state, which may interact with the electrons inside the metal, provided the cesium coverage is close to the optimum value of 0.8, i.e., the work function of the surface is close to 1.6 eV. In this case, electron transfer from the metal to the molecules may take place forming an intermediate $CsH^-$ ion, which then dissociates under bombardment by ions and/or atoms into Cs and $H^-$.

EXAMPLE

The cesium containing substance used in one example is 25% by weight Cesium-bichromate, i.e., $Cs_2Cr_2O_7$, and 75% by weight Ti powder that vaporized at a temperature below about 600° C. Advantageously, the mixture, in the form of a powder, is tamped down to fill the cartridge with a solid pellet having the cylindrical shape of the inside of the cartridge.

In this example, the cartridge is a molybdenum metal cylinder with an outer diameter of 0.21 in., a length of 0.65 in., and the bottom surface is 3.9 mm. in diameter. The cavity is 0.125 in. in diameter, and 0.61 in. long, and the orifices are 0.010 in. in diameter.

The heater comprising a 1.59 mm diameter filament, heats the cartridge to between 600° C and 700° C. The filament, which is at about 1000° C, also heats the cathode, which is oxide coated and negatively pulsed in the magnet. The latter has a current of 2 ~ 2.5A in 1350 turns for producing a strong magnetic field. The electrical field potential is 70 kW/cm while the bottom surface of the cartridge is at 20 A/cm$^2$ with a cesium monolayer about one atom thick containing about $10^{12}$ atoms of Cs/cm$^3$ in a vacuum of about 1 Torr (mm Hg).

In other embodiments using tantalum, titanium, nickel or copper cartridges, the negative ion currents are somewhat reduced. Like reduced results are obtained with thicker Cs coatings and/or smaller cartridge and cavity sizes than these listed above, while larger sizes also involve problems in scaling all the other elements correspondingly to obtain the desired results.

The measurements with the HDD source operating in the cesium mode, shows that it is possible to obtain $H^-$ beams in excess of 60 m A with current densities of at least 1.2 A/cm$^2$, and these can be raised by suitable scaling to densities of more than 2 amperes/cm$^2$ with the parameters illustrated in the below presented Table.

A typical extracted beam profile measurement 23.5 cm downstream of the extractor shows a beam diameter of 4.6 cm (FWHM) for a 44 m A, 40 keV negative ion beam.

This invention has the advantage of providing a specific, cylindrical, cesium coated cartridge in the annulus of a plasma ring for increasing the current density of a negative ion beam from a hollow-discharge duoplasmatron source. To this end, the cesium coated surface is located in a potential well in the annulus of the plasma ring so that the $H^-$ is produced and ejected in a beam along a trajectory parallel with the axis of the plasma ring from the annulus thereof. Additionally, existing duoplasmatrons can be easily adapted to the operation of this invention, such as to provide the required heater, electrical potential and location by a suitable combination therewith.

TABLE

| Parameters of the HDD Source in Pure Hydrogen Mode | |
|---|---|
| Arc Current | 140 A |
| Arc Voltages | 80 V |
| Rod Potential | Floating |
| Magnetic Field | 4000 AT |
| Pulse Length | 0.9 ms |
| Tantalum Rod Tip Diameter | $\phi$ 5.4 mm |
| Rod Tip-Anode Distance | 6.8 mm |
| Emission Aperture | $\phi$ 2.45 mm |
| Hydrogen Pressure | $> 100\ \mu$ |
| $H^-$ Current | 60 mA |
| $H^-$ Current Density at Anode Aperture | 1.2 A/cm$^2$ |
| Electron Current | 1.6 A |
| Emittance (Normalized) | 0.2 $\pi$ cm.mrad |
| Extraction Voltage | 40 kV |
| Intermediate Electrode Aperture | $\phi$ 11.0 mm |
| Extractor Aperture | $\phi$ 5.0 mm |

What is claimed is:

1. The method of producing negatively charged hydrogen ions, comprising the steps of:

a. forming an annular hydrogen plasma ring containing energetic hydrogen atoms in the annulus thereof;

b. interacting the hydrogen atoms and ions with a flat, circular, Cs coated metal surface in the annulus of the plasma ring to form negative hydrogen ions; and c. maintaining the flat, circular Cs coated metal surface in an electrical potential well for extracting the negative hydrogen ions along the axis of the annular hydrogen plasma ring.

2. The method of claim 1 in which the energetic hydrogen atoms and ions impinge on the Cs coated surface from the plasma ring around 360°.

3. The method of claim 2 in which uniformly energetic hydrogen atoms impringe on the coated surface continuously obliquely around 360°.

4. The method of claim 3 including the step of maintaining the metal surface with a Cs coating thereon that is a monolayer about one atom thick containing about $10^{12}$ atoms of Cs/Cm$^3$ in a vacuum of about 1 torr.

5. The invention of claim 4 in which the Cs coated surface is maintained at between 600° - 700° C.

6. Apparatus for use with a source of an annular hydrogen plasma, comprising:

a. longitudinally extending, foraminous cartridge means having a cylindrical side wall; one, flat, circular, tip end surface and an opposite other end; an open-ended cavity; and uniformly spaced orifices for venting the cavity through the side wall to coat the surface;

b. electrical potential means for producing a potential well around the one tip end of the cartridge means;

c. source means of an annular hydrogen plasma ring containing energetic hydrogen atoms and ions in its annulus having removable connection means inside the annulus of the plasma ring at the opposite other end of the cartridge means from the one tip end for selectively opening and closing the cavity and for connecting the cartridge means to the electrical potential means in the annulus of the plasma ring;

d. solid means containing cesium that is selectively loaded into the cavity by opening and closing the cavity with the connection means; and e. electrical heat source means selectively supported by and insulated from the connection means for vaporizing the cesium by heating the cartridge means to produce cesium vapor that comes out of the orifices from the cavity for coating the one tip end with the cesium for interaction with the energetic hydrogen atoms and ions from the hydrogen plasma in the annulus of the plasma ring for producing negative hydrogen ions at the one tip end of the cartridge means and for extracting them in the electrical potential well along a trajectory co-axial with the axis of the annular hydrogen plasma.

7. The apparatus of claim 6 having connection means at the opposite other end of the cartridge from the tip end thereof for selectively attaching the cartridge means in the annulus of the plasma ring to the heat source means by selectively opening the cavity for loading the solid cesium containing means therein.

8. The apparatus of claim 7 having four equally spaced orifices symmetric with the axis of the cartridge and radiating symmetrically at right angles thereto in the annulus of the plasma ring.

9. The apparatus of claim 8 in which the solid means is a mixture of cesium-biochromate and titanium that vaporizes at a temperature below about 600° C.

10. The apparatus of claim 9 in which the cartridge means is a tantalum metal cylinder with an outer diameter of 0.21 in., a length of 0.65 in., a cavity 0.125 in. in inner diameter and 0.61 in. long, and in which each of the orifices is 0.010 in. in diameter and diametrically opposed to another orifice, and the heat source means is connected to the cartridge means for heating the cartridge means to at least between 600° C and 700° C.

* * * * *